US010631701B2

(12) United States Patent
Kwak et al.

(10) Patent No.: US 10,631,701 B2
(45) Date of Patent: Apr. 28, 2020

(54) VACUUM CLEANER AND HANDLE THEREOF

(71) Applicant: LG ELECTRONICS INC., Seoul (KR)

(72) Inventors: Donghoon Kwak, Seoul (KR); Jaehwan Ko, Seoul (KR); Hyukdo Kweon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 144 days.

(21) Appl. No.: 15/895,198

(22) Filed: Feb. 13, 2018

(65) Prior Publication Data

US 2019/0110654 A1 Apr. 18, 2019

(30) Foreign Application Priority Data

Oct. 17, 2017 (KR) ..... 10-2017-0134759

(51) Int. Cl.

| | |
|---|---|
| ***A47L 9/28*** | (2006.01) |
| ***A47L 11/40*** | (2006.01) |
| ***A47L 5/00*** | (2006.01) |
| ***A47L 9/32*** | (2006.01) |
| ***A47L 5/28*** | (2006.01) |

(52) U.S. Cl.

CPC ..... *A47L 9/2852* (2013.01); *A47L 5/00* (2013.01); *A47L 5/28* (2013.01); *A47L 9/2805* (2013.01); *A47L 9/2857* (2013.01); *A47L 9/2878* (2013.01); *A47L 9/325* (2013.01); *A47L 11/4066* (2013.01); *A47L 11/4075* (2013.01)

(58) Field of Classification Search

CPC ..... A47L 9/2852; A47L 5/28; A47L 9/325; A47L 9/2857; A47L 9/2878; A47L 9/2805; A47L 5/00; A47L 11/4075; A47L 11/4066

See application file for complete search history.

(56) References Cited

U.S. PATENT DOCUMENTS

| | | | |
|---|---|---|---|
| 6,061,869 | A | 5/2000 | Ettes et al. |
| 2007/0214598 | A1 | 9/2007 | Zahuranec |
| 2016/0302636 | A1 | 10/2016 | Kim et al. |

FOREIGN PATENT DOCUMENTS

| | | |
|---|---|---|
| EP | 3 064 117 | 9/2016 |
| JP | 2006-240361 | 9/2006 |
| KR | 10-2015-0063945 | 6/2015 |

OTHER PUBLICATIONS

European Search Report dated Dec. 4, 2018 issued in Application No. 18167153.8.

Korean Office Action dated Jan. 22, 2019 issued in Application No. 10-2017-0134759.

*Primary Examiner* — David Redding

(74) *Attorney, Agent, or Firm* — Ked & Associates, LLP

(57) ABSTRACT

The present disclosure relates to a cleaner according to one embodiment, which includes a cleaner body, a grip member disposed on the cleaner body to be gripped by a user, a pressure sensor part disposed in the grip member to detect pressure applied by the user to a part of an outer surface of the grip member, a driving unit disposed at a lower portion of the cleaner body to move the cleaner body, and a controller to control the driving unit based on the detected pressure.

20 Claims, 6 Drawing Sheets

VACUUM CLEANER AND HANDLE THEREOF

CROSS-REFERENCE TO RELATED APPLICATION(S)

This application claims priority under 35 U.S.C. § 119 to Korean Application No. 10-2017-0134759, filed on Oct. 17, 2017, whose entire disclosure(s) is/are hereby incorporated by reference.

BACKGROUND

1. Field

The present disclosure relates to a vacuum cleaner capable of moving a cleaner body by assisting a user, a handle of the vacuum cleaner, and a method of controlling the cleaner, and more particularly, a vacuum cleaner capable of moving a cleaner body by facilitating a user's operation.

2. Background

Generally, a vacuum cleaner is an apparatus that sucks dust, foreign substances and the like existing on a surface to be cleaned by using a suction motor provided inside a main body, and then filters the dust and foreign substances within the main body.

In recent years, a battery is mounted in the vacuum cleaner to supply power to the cleaner, such that a cleaning function can be executed even in a state where the cleaner is not connected to an external power source through a power line. In addition, the vacuum cleaner may include a driving unit (or drive assembly) that generates driving force by receiving power from the battery, and a controller of the vacuum cleaner may perform autonomous travel by controlling the driving unit according to a preset algorithm.

The vacuum cleaner may be classified into an upright type vacuum cleaner in which a suction nozzle is connected to a main body and moves together with a main body, and a canister type vacuum cleaner in which a suction nozzle is connected to a main body through an extension pipe, a handle, a hose, or the like.

Of the two types of vacuum cleaners, the upright type vacuum cleaner includes a cleaner main body in which a suction motor for generating suction force and the like are disposed, a suction nozzle for sucking dust, foreign substances and the like, which are present on a surface to be cleaned, into the main body by the suction force generated in the suction motor, a handle provided on a top of the main body to be gripped by a user such that the suction nozzle moves along the surface to be cleaned, and the like.

That is, when power is applied to the main body and the suction motor is driven, suction force is generated, and air containing dust and foreign substances scattered on the surface to be cleaned is sucked into the suction nozzle by the suction force.

The air containing the dust, the foreign substances, and the like flows into the main body, and the dust, the foreign substances, and the like are separated from the air into a dust collecting container mounted in the main body by a cyclone principle.

The separated dust, foreign substances, and the like are collected in the dust collecting container, and the separated air is discharged to outside of the main body through an air discharge port.

Since such vacuum cleaner is moved only by the user's force, the user's fatigue is caused when friction against the surface to be cleaned or a load of the cleaner is great while the user cleans the surface with moving the cleaner.

In particular, the upright type vacuum cleaner has a relatively heavy weight as compared with other types of vacuum cleaners, which causes user's inconvenience in using the upright type vacuum cleaner.

In order to solve such problems, the typical upright type vacuum cleaner may be provided with wheels which are rotated in response to physical force applied by the user.

However, there is a problem that it is difficult to smoothly move the vacuum cleaner in a user-desired direction merely by employing the wheels which are passively rotated.

That is, in case of a vacuum cleaner having only passively-rotating wheels, when the user applies physical force to the vacuum cleaner in a specific direction, the wheels are rotated merely in response to the applied physical force, and any separate driving force for supplementing the user's physical force is not applied. Accordingly, when the user moves the upright type cleaner having only the passively-rotating wheels, the user cannot easily move the heavy main body of the cleaner.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Hereinafter, description will be given in detail of embodiments disclosed herein. Technical terms used in this specification are merely used for explaining specific embodiments, and should not be constructed to limit the scope of the technology disclosed herein.

As broadly described and embodied herein, an aspect of the present disclosure is to provide a vacuum cleaner, which performs a travel algorithm that reflects user's intention, to facilitate movement or travel of an upright type vacuum cleaner according to the user's intention, and a handle of the cleaner.

Another aspect of the present disclosure is to provide a vacuum cleaner, which actively reflects user's intention by providing separate physical force that assists movement of the cleaner in a user-intended direction, and a handle of the cleaner.

Another aspect of the present disclosure is to provide an upright type vacuum cleaner that follows a user, and a handle of the cleaner.

According to a vacuum cleaner and a control method thereof according to the present disclosure, user's intention to move the cleaner can be recognized so that auxiliary driving force can be provided in a direction intended by the user, thereby improving user's convenience.

Further, the user of the vacuum cleaner according to the present disclosure can easily move a cleaner body in a desired direction even with small force. In addition, according to these advantages, a load applied on the user's finger or wrist can be minimized, thereby improving the user's convenience.

Figure 1:
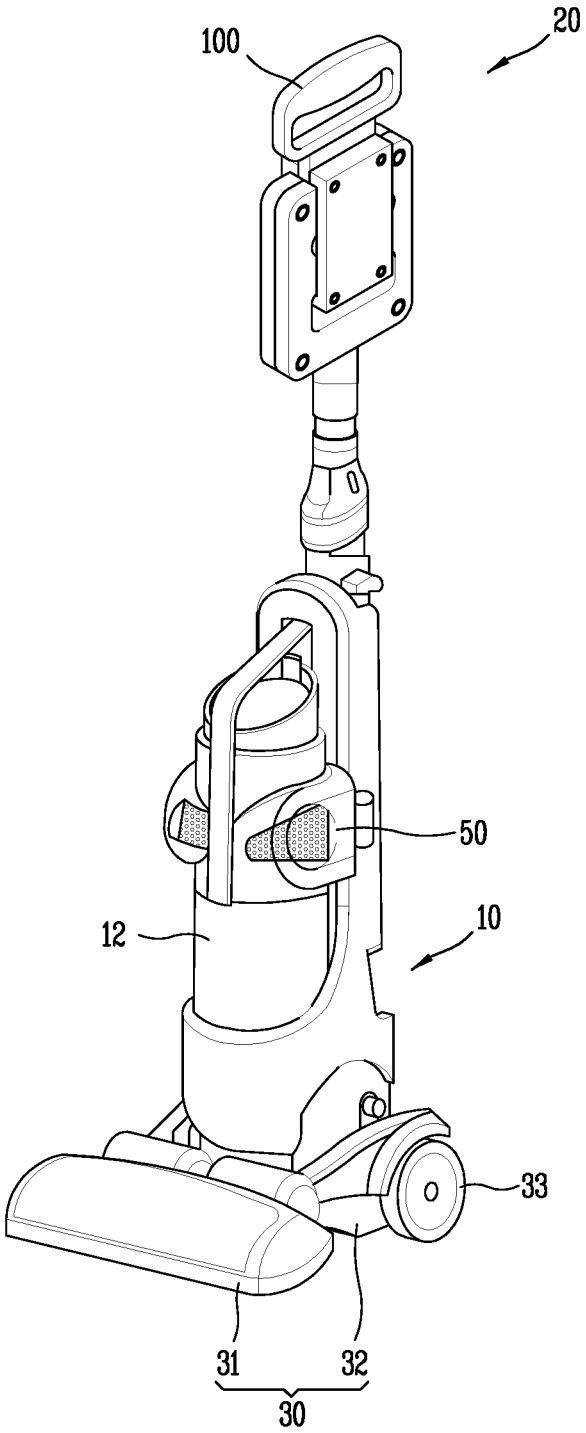
FIG. 1 is a conceptual view illustrating a vacuum cleaner to which the present disclosure is applicable.

Referring to FIG. 1, a vacuum cleaner according to the present disclosure includes a cleaner body 10 to which a dust collecting container 12, in which dust and foreign substances existing on a surface to be cleaned, is mounted, a suction nozzle 30 disposed at a lower side of the cleaner body 10 such that the cleaner body 10 is mounted thereto, and configured to suck the dust and foreign substances scattered on the surface to be cleaned together with air, and a cleaner handle 100 provided on an upper side of the cleaner body 10 and gripped by the user to perform cleaning.

The cleaner body 10 is rotatably coupled to an upper portion of the suction nozzle 30 such that an arrangement angle with respect to the surface to be cleaned can be varied, and the user may support the cleaner body 10 to maintain a state of the cleaner body 10 being rotated toward the surface to be cleaned.

The dust collecting container 12 is detachably coupled to a front surface of the cleaner body 10. The dust collecting container 12 is provided with a dust separating member 50 for separating dust and foreign substances contained in air sucked into the cleaner body 10 by a cyclone principle.

That is, the air sucked into the cleaner body 10 through the suction nozzle 30 flows into the dust collecting container 12, and the dust and foreign substances contained in the air introduced into the dust collecting container 12 are filtered by the dust separating member 50 and collected in the dust collecting container 12. The clean air from which the dust and foreign substances have been separated is discharged to outside of the cleaner body 10.

Since the dust collecting container 12 is detachably coupled to the cleaner body 10, the user can detach the dust collecting container 12 from the cleaner body 10 to throw away the dust and foreign substances collected in the dust collecting container 12.

Meanwhile, the dust collecting container 12 illustrated in FIG. 1 has a cylindrical shape, but may alternatively be formed in a polygonal column shape such as a rectangular column, and the like.

The suction nozzle 30 includes a nozzle unit 31 for sucking dust and foreign substances scattered on the surface to be cleaned together with air, and a mounting unit 32 on which the cleaner body 10 is mounted.

When the user carries out cleaning, the nozzle unit 31 moves back and forth and to right and left relative to the surface to be cleaned in order to suck dust, foreign substances, and the like present on the surface to be cleaned.

A pair of wheels 33 is rotatably provided on both sides of the mounting unit 32 which is connected to the nozzle unit 31 and on which the cleaner body 10 is mounted.

That is, when the nozzle unit 31 moves relative to the surface to be cleaned, the mounting unit 32 connected to the nozzle unit 31 moves together. The wheels 33 smoothly rotate such that the suction nozzle 30 smoothly moves along the surface to be cleaned.

On the other hand, a cleaner handle 100 is provided on the upper side of the cleaner body 10. Accordingly, the user can grasp (hold, grip) the cleaner handle 100 to support the cleaner body 10 such that the cleaner body 10 is maintained in a rotated state by a predetermined angle.

The cleaner handle 100 is provided with an input unit (not shown) provided on a portion where the user actually grips the hand. The input unit may enable the user to input a signal while settling his or her hand on the cleaner handle 100.

The input unit is positioned within a range where the user grips the cleaner handle 100. Accordingly, the user can input a signal without moving a gripped position with respect to the cleaner handle 100 while the user grips the cleaner handle 100. That is, the cleaner handle 100 is a member that allows the user to move the vacuum cleaner, whereas the input unit is a portion of the cleaner handle 100 with which the user's hand is actually brought into contact.

Therefore, the input unit may be provided with a plurality of grooves corresponding to fingers so that the fingers can be brought into contact with the grooves when user grips the cleaner handle. This may facilitate the user to input a signal to the input unit.

The user may move the cleaner by inputting a signal to the input unit while settling the hand on the input unit.

Figure 2A:
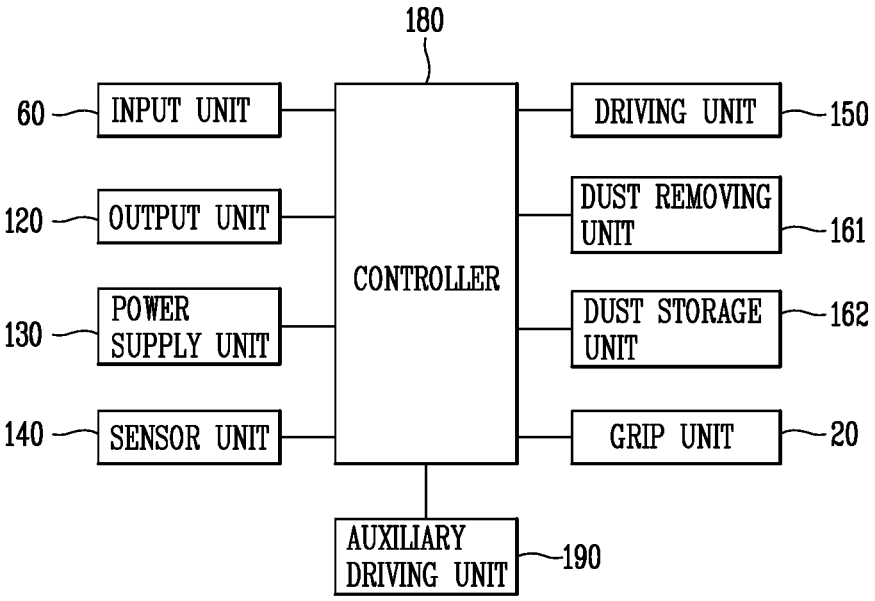
FIGS. 2A and 2B are block diagrams of a cleaner according to the present disclosure.

Referring to FIG. 2A, a block diagram illustrating components of the vacuum cleaner illustrated in FIG. 1 is shown.

The vacuum cleaner may include at least one of an input unit 60, an output unit 120, a power supply unit 130, a sensor unit 140, a driving unit 150 (or drive assembly), a dust removing unit 161, a dust storage unit 162, a cleaner handle 100, a controller 180, and an auxiliary driving unit 190.

The input unit 60 receives various control commands for the cleaner from the user. The input unit 60 may include one or more buttons. For example, the input unit 60 may include an adjustment button for adjusting an output of the cleaner, a power button for turning on and off the cleaner, a mode setting button for setting an operation mode of the cleaner, and the like.

Further, the input unit 60 may be installed on the cleaner handle 100 of the cleaner. In addition, the input unit 60 may be implemented as a hard key, a soft key, a touch pad, or the like. For example, the input unit 60 may implement a form of a touch screen together with the output unit 120.

Meanwhile, the output unit 120 may be installed on the cleaner body 100 or the cleaner handle 100. Of course, an installation location and an installation type of the output unit 120 may vary. For example, the output unit 120 may display information related to an output level, a battery status, an operation mode, and the like on the screen.

The output unit 120 may be configured as one device of a light emitting diode (LED), a liquid crystal display (LCD), a plasma display panel, and an organic light emitting diode (OLED).

The output unit 120 may further include an audio output module for audibly outputting information related to an operation of the cleaner performed by the controller 180. For example, the output unit 120 may output warning sound to the outside, in response to a warning signal generated by the controller 180.

In this case, the audio output module may be means, such as a beeper, a speaker or the like for outputting sounds, and the output unit 120 may output sounds to the outside through the audio output module using audio data or message data, which has a predetermined pattern stored in a memory (not illustrated).

The power supply unit 130 may apply a direct current (DC) voltage or an alternating current (AC) voltage to the vacuum cleaner.

That is, the power supply unit 130 may include a first power supply module (not illustrated) that supplies AC power supplied from an external power supply device or a commercial power source directly into at least one component included in the cleaner. The first power supply module may include a rectifying circuit for converting AC power to DC power, a cord for transmitting the AC power from a commercial power source, and a cord reel for winding the cord therearound.

In addition, the power supply unit 130 may include a second power supply module (not illustrated) that supplies DC power supplied from the battery to at least one component included in the cleaner. That is, the second power supply module may include a battery and a power terminal, and may supply power to the components of the vacuum cleaner using the DC power generated in the battery.

Meanwhile, the power supply unit 130 may store power supplied from an external power supply device in the battery, and supply the stored power to at least one component included in the cleaner. At this time, the battery may receive power from the external power supply device through the power supply unit by a wired/wireless charging scheme. That is, the battery may receive power by being directly connected to the external power supply device by a component such as a power consent through the power supply unit 130 included in the cleaner, or by being connected to the external power supply device using one of a magnetic resonance coupling method, an electromagnetic induction method, and a radiowave method.

The vacuum cleaner can receive power from the battery provided therein when it is not connected to the external power source.

Figure 2B:
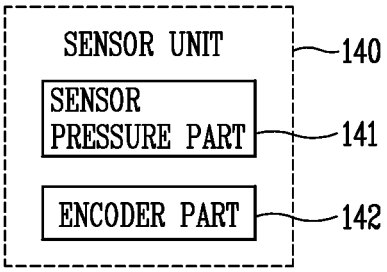

Referring to FIG. 2B, the sensor unit 140 may include a pressure sensor part 141 and an encoder part 142.

The pressure sensor part 141 may be disposed on an outer surface of the cleaner handle 100. That is, the pressure sensor part 141 may protrude to the outer surface of the cleaner handle 100. When the user holds the cleaner handle 100, the pressure sensor part 60 may be brought into contact with the user's hand.

That is, the pressure sensor part 141 may be disposed in the cleaner handle 100 so as to sense pressure that the user applies to a part of an outer surface of a grip unit 20.

Although not illustrated in FIG. 2B, the sensor unit 140 may include at least one of an external signal sensor, a front sensor, a cliff sensor, a lower camera sensor, and an upper camera sensor.

The external signal sensor may sense an external signal of a moving robot. The external signal sensor may be, for example, an infrared ray (IR) sensor, an ultrasonic sensor, a radio frequency (RF) sensor, or the like.

The driving unit 150 provides suction force by a motor. Here, the motor may be a Brushless DC (BLDC) motor used in a general cleaner, but is not limited thereto.

The driving unit 150 may include a suction motor, and a suction fan rotated by the suction motor to generate the suction force.

The driving unit 150 may include wheels for moving the cleaner body 10, and a driving motor for transmitting driving force to the wheels.

Hereinafter, a more detailed embodiment of the driving unit 150 according to the present disclosure will be described with reference to FIGS. 5A to 5C.

The dust removing unit 161 and the dust storage unit 162 may be installed inside or outside the cleaner body 10 to facilitate coupling with and separation from the cleaner body 10. For example, at least one of the dust removing unit 161 and the dust storage unit 162 may include a handle. The user may easily attach and detach at least one of the dust removing unit 161 and the dust storage unit 162 from the cleaner body 10 by holding the handle.

Meanwhile, the dust storage unit 162 includes a case. That is, the dust storage unit 162 may include a container for storing dust. The case communicates with the dust removing unit 161 to store therein dust separated in the dust removing unit 161. That is, the case forms a space or region which is separate from the dust removing unit 161, and stores dust therein.

The controller 180 controls the overall operation of the components included in the cleaner. The controller 180 may provide or process appropriate information or functions to the user by processing signals, data, information, etc. input or output through the above-mentioned components or by activating application programs stored in a memory (not illustrated).

Also, the controller 180 may control at least some of the components illustrated in FIG. 2A, to execute the application programs that have been stored in the memory. Further, the controller 180 may operate at least two of the components included in the cleaner in a combination manner for executing the application program.

The controller 180 may determine whether the user has gripped the cleaner handle 100 based on a temperature value sensed by a temperature sensor (not illustrated) or a pressure value sensed by the pressure sensor part 141.

Specifically, the controller 180 may determine that the user has gripped the cleaner handle 100 when a temperature sensed by the temperature sensor disposed in the cleaner handle 100 is a reference temperature value or more. For example, the reference temperature value may be set to substantially correspond to a body temperature. In addition, the controller 180 may set the reference temperature differently according to a current date or time. In addition, the controller 180 may store temperature values sensed by the temperature sensor at predetermined time intervals, and may set a reference temperature using the stored temperature values.

The controller 180 may determine that the user has gripped the cleaner handle 100 when the temperature sensed by the temperature sensor is within a reference temperature range. For example, when the sensed temperature exceeds an upper limit of the reference temperature range, the controller 180 may determine that heat applied to the temperature sensor is due to an object other than the user, and stop the operation of the driving unit 150.

The controller 180 may also determine that the user has gripped the cleaner handle 100 when pressure sensed by the pressure sensor part 141 included in the cleaner handle 100 is a reference pressure value or more.

Specifically, the reference pressure value may be set by the user. The output unit 120 may output guide information to the user to set the reference pressure value when the cleaner is initially operated, and the controller 180 may set the reference pressure value based on pressure applied to the pressure sensor part 141 after the guide information is output.

For example, the output unit 120 may output voice information "Please grip the handle" when the cleaner is initially driven or when the cleaner operates in a mode for resetting the reference pressure value. The controller 180 may set the reference pressure value by processing information related to the pressure applied to the pressure sensor part 141 at a plurality of time points during a preset time interval after the voice information is output. On the other hand, the guide information is not limited to the voice information and may alternatively be output in various forms.

The controller 180 may determine that the user has gripped the cleaner handle 100 when the sensed pressure is within the reference pressure range. On the other hand, when the sensed pressure exceeds the upper limit of the reference pressure range, the controller 180 may determine that the pressure applied to the pressure sensor part 141 is due to an object other than the user, and stop the operation of the driving unit 150.

The controller 180 may operate the driving unit 150 when it is determined that the user has gripped the cleaner handle 100, and stop the driving unit 150 when it is determined that the user has not gripped the cleaner handle 100.

That is, the controller 180 may control the driving unit 150 to generate suction force of the cleaner when it is determined using at least one of the temperature sensor and the pressure sensor part 141 provided in the cleaner handle 100 that the user has gripped the cleaner handle 100.

In one embodiment, the controller 180 may control the driving unit 150 to adjust strength (intensity, magnitude) of the suction force generated in the driving unit 150 according to strength of the sensed pressure. That is, the controller 180 may control the driving unit 150 to increase an output of the cleaner as the user grips the cleaner handle 100 stronger.

The controller 180 may be provided inside the cleaner body 10 of the cleaner or inside the cleaner handle 100.

The input unit 60, the output unit 120, the sensor unit 140 and the controller 180 of the cleaner according to one embodiment may be provided inside or outside the cleaner handle 100.

The input unit 60, the output unit 120, the power supply unit 130, the sensor unit 140, the driving unit 150, and the controller 180 of the cleaner according to another embodiment of the present disclosure may be provided in the cleaner body of the cleaner.

The input unit 60, the output unit 120, the sensor unit 140, and the controller 180 of the cleaner according to another embodiment may be provided in the cleaner handle 100 and the cleaner body, respectively.

Hereinafter, embodiments of the present disclosure related to the cleaner handle 100 illustrated in FIG. 3 will be described.

Figure 3:
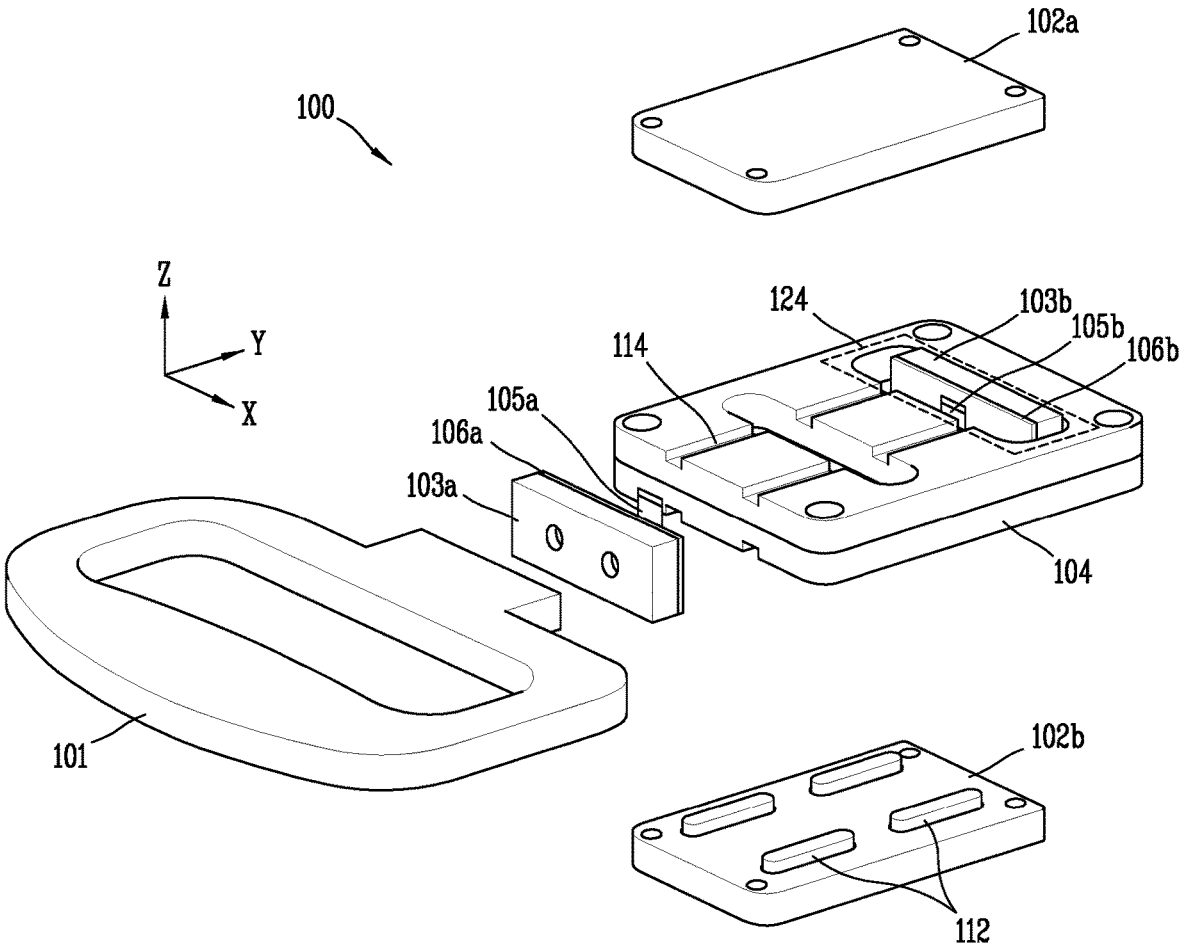
FIG. 3 is a conceptual view illustrating detailed components of a cleaner handle according to the present disclosure.

For reference, a positive direction of a Y-axis illustrated in FIG. 3 is defined as a forward direction of the cleaner.

A negative direction of the Y-axis illustrated in FIG. 3 is defined as a backward direction of the cleaner.

Further, a positive direction of a Z-axis illustrated in FIG. 3 is defined as an upward direction.

In addition, a negative direction of the Z-axis illustrated in FIG. 3 is defined as a downward direction.

A positive direction of an X-axis illustrated in FIG. 3 is defined as a left direction.

A negative direction of the X-axis illustrated in FIG. 3 is defined as a right direction.

The cleaner handle 100 according to the present disclosure may include a grip member 101 (or grip, handle), a guide module 102 (or guide assembly, slide), a handle body 104, and a pressure sensor 105.

Specifically, the grip member 101 may be formed to be movable in the forward direction or the backward direction of the cleaner, and gripped by the user.

The guide module 102 may be coupled with the grip member 101 to guide the grip member 101 to move in the forward direction or the backward direction of the cleaner.

The handle body 104 may allow the guide module 102 to be movable in the forward direction or the backward direction of the cleaner.

A portion of the guide module 102 may be formed to be inserted through a hole formed in the handle body 104. Further, a portion of the guide module 102 may be formed to be in contact with different surfaces of the handle body 104.

The guide module 102 may be slidably moved relative to the handle body 104 by external force applied by the user.

In one example, the guide module 102 may move in the forward or backward direction of the cleaner in a state of being in contact with the handle body 104.

A pressure sensor 105 may sense pressure generated between the guide module 102 and the handle body 104, in response to the grip member 101 moving in the forward or backward direction of the cleaner.

In detail, referring to FIG. 3, the handle body 104 may be provided with grooves 114 (or channel, recess) on a surface, on which the guide module 102 is provided, of outer surfaces of the handle body 104, to guide the movement of the guide module 102.

As illustrated in FIG. 3, each of the grooves 114 may be formed to have a width of a predetermined length so as to be parallel with the forward direction or the backward direction of the cleaner.

Also, referring to FIG. 3, the guide module 102 may include a first plate 102*a* and a second plate 102*b*. That is, the guide module 102 may be formed of an assembly of the first plate 102*a* and the second plate 102*b*.

Referring to FIG. 3, the guide module 102 may include a first coupling member 103*a* (or coupling plate or block, connector) and a second coupling member 103*b* for coupling the first and second plates 102*a* and 102*b*. The coupling members may be formed as a plate. The plate may also have a varying thickness and have a block shape.

The first coupling member 103*a* may be located between the handle body 104 and the grip member 101.

The second coupling member 103*b* may be located in a hole 124 (or opening, recess) formed in the handle body 104.

One end of the first plate 102*a* at the side of the grip member 101 and one end of the second plate 102*b* at the side of the grip member 101 may be coupled to both ends of the first coupling member 103*a*, respectively.

One end of the first plate 102*a* at the side of the cleaner body and one end of the second plate 102*b* at the side of the cleaner body may be coupled to both ends of the second coupling member 103*b*, respectively.

That is, the guide module 102 may be formed of an assembly of the first plate 102*a*, the second plate 102*b*, the first coupling member 103*a*, and a second coupling member 103*b*. The first and second coupling members may be formed integrally to the first or second plates, one on each respective plate or both on a single plate, then assembled together.

In one embodiment, the handle body 104 may be located between the first plate 102*a* and the second plate 102*b*.

In another embodiment, a part of the assembly forming the guide module 102 may be inserted through the hole 124 formed in the handle body 104.

Referring to FIG. 3, at least one of the first and second plates 102*a* and 102*b* may be provided with ribs 112 (or guides, rails).

Specifically, the ribs 112 protruding toward the handle body 104 may be provided on surfaces of the first and second plates 102*a* and 102*b*, which face the handle body 104, respectively.

In addition, the ribs 112 provided on at least one of the first and second plates 102*a* and 120*b* may be inserted into the grooves 114 formed in the handle body 104.

For example, a shape of the groove 114 may be formed to substantially correspond to a shape of the rib 112.

In another example, a width of the groove 114 may be greater than a width of the rib 112.

In another example, when the width of the groove 114 is narrower than the width of the rib 112, the rib 112 may be made of an elastic material.

Materials making the ribs 112 and the grooves 114 may be selected so that frictional force generated between an outer surface of the rib 112 and an outer surface of the groove 114 has a predetermined strength or less.

On the other hand, the shapes of the grooves 114 and the ribs 112 are not limited to the embodiment illustrated in FIG. 3 and may alternatively be formed in various shapes to maintain the coupled state between the guide module 102 and the handle body 104 without interfering with the movement of the guide module 102.

Referring to FIG. 3, the pressure sensor part 141 may include a first pressure sensor unit 105*a* (or pressure sensor) and a second pressure sensor unit 105*b* (or pressure sensor). The pressure sensor 105*a*, 105*b* may be one or more types of sensors that sense an amount of pressure or force as well as rates of change of pressure and force.

Specifically, when the user moves the grip member 101 in the forward direction of the cleaner and thus the guide module 102 and the handle body 104 are brought into contact with each other, the first pressure sensor unit 105*a* may sense information related to strength of pressure applied by the guide module 102 to a part of the handle body 104.

When the user moves the grip member 101 in the backward direction of the cleaner and thus the guide module 102 and the handle body 104 are brought into contact with each other, the second pressure sensor unit 105*b* may sense information related to strength of pressure applied by the guide module 102 to a part of the handle body 104.

As illustrated in FIG. 3, the first pressure sensor unit 105*a* may be provided on one surface of the first coupling member 103*a* of the guide module 102. For example, the one surface of the first coupling member 103*a* provided with the first pressure sensor unit 105*a* may be a surface, which faces the handle body 104, of outer surfaces of the first coupling member 103*a*.

The first pressure sensor unit 105*a* may also be provided on one surface of the first coupling member 103*a* of the guide module 102.

For example, the one surface of the first coupling member 103*a* provided with the first pressure sensor unit 105*a* may face the handle body 104.

In another example, the one surface of the first coupling member 103*a* provided with the first pressure sensor unit 105*a* may be a surface, which faces another surface of the first coupling member 103*a* provided with the grip member 101, of the outer surfaces of the first coupling member 103*a*. That is, the grip member 101 may be coupled to the another surface of the first coupling member 103*a*, which is opposite to the one surface provided with the first pressure sensor unit 105*a*.

Referring to FIG. 3, a buffer member 106 (e.g., 106*a*) may be provided between the first pressure sensor unit 105*a* and the first coupling member 103*a*. Similarly, a buffer member 106 (e.g., 106*b*) may be provided between the second pressure sensor unit 105*b* and the second coupling member 103*b*.

The buffer member 106 may prevent breakdown of the pressure sensor part 141 by reducing an impact applied by the guide module 102 to the pressure sensor part 141.

A distance between a point where the first pressure sensor unit 105*a* is installed and a point where the second pressure sensor unit 105*b* is installed may be shorter than a length of the handle body 104 in the forward direction or the backward direction of the cleaner.

In one embodiment, in a state where a part of the guide module 102 is inserted through the hole of the handle body 104, a polygon which is formed by an inner circumferential surface of the guide module 102 may have a length in the forward or backward direction of the cleaner, which is shorter than a length of the handle body 104 in the forward or backward direction of the cleaner, so that the guide module 102 can be slid relative to the handle body 104.

In another embodiment, in a state where the first and second plates 102*a* and 102*b* of the guide module 102 cover a part of both surfaces of the handle body 104, a distance between one surface of the first coupling member 103*a* and one surface of the second coupling member 103*b* may be shorter than the length of the handle body 104 in the forward or backward direction of the cleaner, so that the guide module 102 can be slid relative to the handle body 104. At this time, the one surface of the first coupling member 103*a* and the one surface of the second coupling member 103*b* may face each other.

As such, a distance between the first coupling member and the second coupling member or a distance between the first pressure sensor unit and the second pressure sensor unit can be shorter than the length of the handle body 104 in the forward or backward direction of the cleaner, and accordingly the first pressure sensor unit and the second pressure sensor unit provided on the first coupling member and the second coupling member, respectively, can be brought into contact with the handle body in a direction of external force applied by the user.

On the other hand, the distance between the point where the first pressure sensor unit 105*a* is installed and the point where the second pressure sensor unit 105*b* is installed may be longer than a distance from an inner circumferential surface of the hole 124 formed in the handle body 104 to an outer surface of the handle body 105 at the side of the grip member 101.

That is, the distance between the one surface of the first coupling member 103*a* and the one surface of the second coupling member 103*b* may be longer than the distance from the inner circumferential surface of the hole 124 formed in the handle body 104 to the outer surface of the handle body 104 at the side of the grip member 101. At this time, the one surface of the first coupling member 103*a* and the one surface of the second coupling member 103*b* may face each other.

As described above, the distance between the first coupling member and the second coupling member or the distance between the first pressure sensor unit and the second pressure sensor unit can be longer than the distance from the inner circumferential surface of the hole 124 formed in the handle body 104 to the outer surface of the handle body 104 at the side of the grip member 101, and thus the guide module 102 can be coupled to the grip member 101 while being inserted through the hole 124 of the handle body 104.

The cleaner handle according to the present disclosure may include a control module (not illustrated) which is separate from the controller 180 of the cleaner, and the control module may determine using a sensed value received from the pressure sensor part 141 whether the user is moving the cleaner forward or backward.

In addition, the pressure sensor part 141 of the cleaner handle according to the present disclosure may be connected to the controller 180 of the cleaner. In this case, the controller 180 may use the sensed value received from the pressure sensor part 141 to determine whether the user is moving the cleaner forward or backward.

That is, the controller 180 may compare an output of the first pressure sensor unit 105*a* with an output of the second pressure sensor unit 105*b* to determine whether the user is moving the cleaner forward or backward.

The controller 180 may also compare the output of the first pressure sensor unit 105*a* with the output of the second pressure sensor unit 105*b* to determine whether the cleaner body is moving forward or backward.

For example, the controller 180 may determine that the user applies external force to the grip member 101 to move the cleaner forward when the output of the first pressure sensor unit 105*a* is larger than the output of the second pressure sensor unit 105*b*.

In another example, the controller 180 may determine that the user applies external force to the grip member 101 to move the cleaner forward when the output of the first pressure sensor unit 105*a* exceeds a reference output value.

In another example, the controller 180 may determine that the user applies external force to the grip member 101 to move the cleaner forward when an increase rate of the output of the first pressure sensor unit 105*a* exceeds a reference increase rate value.

In another example, the controller 180 may determine that the user applies external force to the grip member 101 to move the cleaner forward when it is determined that a rate of change of the output of the first pressure sensor unit 105*a* is increasing while monitoring the output of the first pressure sensor unit 105*a*.

In addition, the controller 180 may control the driving unit 150 to provide auxiliary driving force in the determined direction.

That is, when it is determined that the user is moving the cleaner forward, the controller 180 may control the driving unit 150 to provide auxiliary driving force in the forward direction. In addition, when it is determined that the cleaner body is moving backward, the controller 180 may control the driving unit 150 to provide auxiliary driving force in the backward direction.

Specifically, when a moving (advancing) direction of the cleaner or a direction that the user wants to move the cleaner is determined, the controller 180 may control the driving unit 150 to generate driving force in the determined advancing direction or increase the existing driving force so as to assist the travel of the cleaner.

Hereinafter, description will be given of an embodiment in which the grip member 101, the guide module 102, and the handle body 104 included in the cleaner handle according to the present disclosure are coupled, with reference to FIG. 4.

Figure 4:
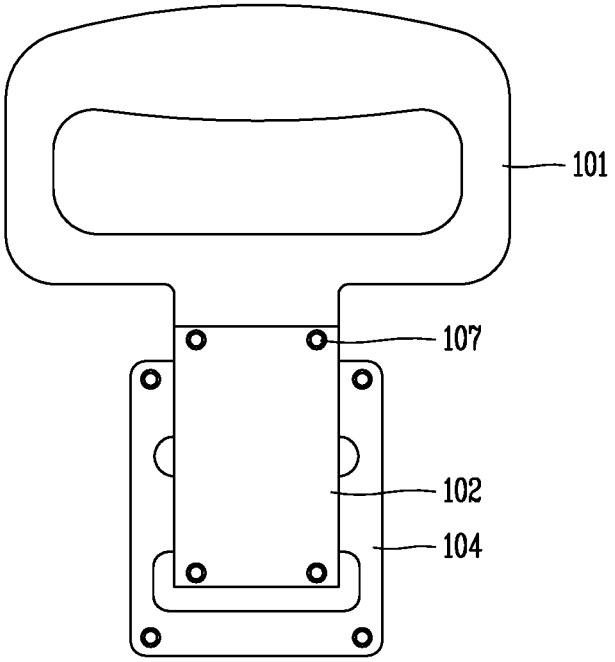
FIG. 4 is a front view of a cleaner handle according to the present disclosure.

As illustrated in FIG. 4, the grip member 101 and one end of the guide module 102 may be coupled by a predetermined number of fixing members 107. For example, the fixing members 107 may be bolts.

In addition, coupled portions between the grip member 101 and the guide module 102 may be provided with accommodating portions for accommodating the fixing members 107, respectively.

Figure 5:
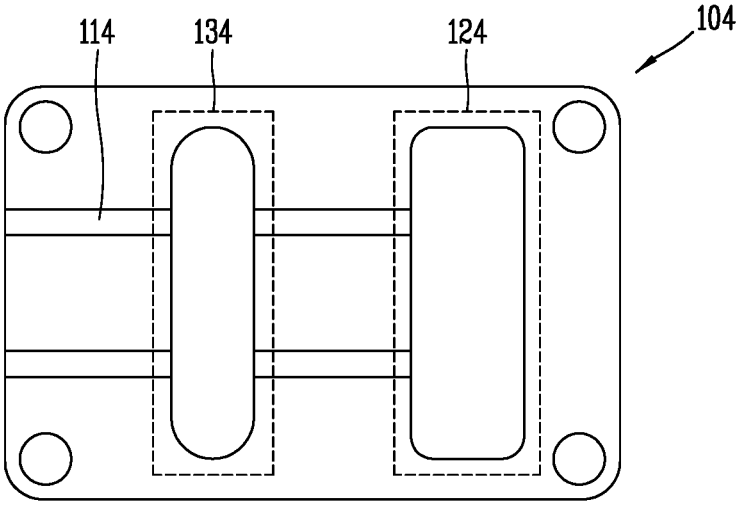
FIG. 5 is a front view of a handle body included in the cleaner handle according to the present disclosure.

Hereinafter, FIG. 5 is a front view of the handle body 104.

As illustrated in FIG. 5, the handle body 104 may be provided with a hole 124 through which a portion of the guide module 102 is inserted.

In addition, referring to FIG. 5, the handle body 104 may be provided with a separate opening 134 (or hole, recess, cutout) that does not allow the guide module 102 to be inserted therethrough. This may result in reducing a weight of the handle body 104.

At this time, a size of the opening 134 may be smaller than or equal to a predetermined ratio value of an area of a surface, which faces an upper side, of the outer surfaces of the handle body 104.

In addition, a volume corresponding to the opening 134 may be less than a predetermined ratio value of a volume of the handle body 104.

On the other hand, although not illustrated in FIG. 5, the handle body 104 may have a plurality of holes in addition to the hole 124 and the opening 134, and the guide module 102 may be placed on the handle body 104 while a part thereof is inserted through one of the hole 124, the opening 134 and the plurality of holes. That is, the guide module 102 may be slid relative to the handle body 104 in a state where the part of the guide module 102 is inserted through one of the hole 124, the opening 134 and the plurality of holes of the handle body 104.

Thus, the guide module 102 formed in various sizes can be settled on the handle body 104.

Hereinafter, one method of operating the cleaner handle according to one embodiment of the present disclosure will be described with reference to FIGS. 6A and 6B.

Figure 6A:
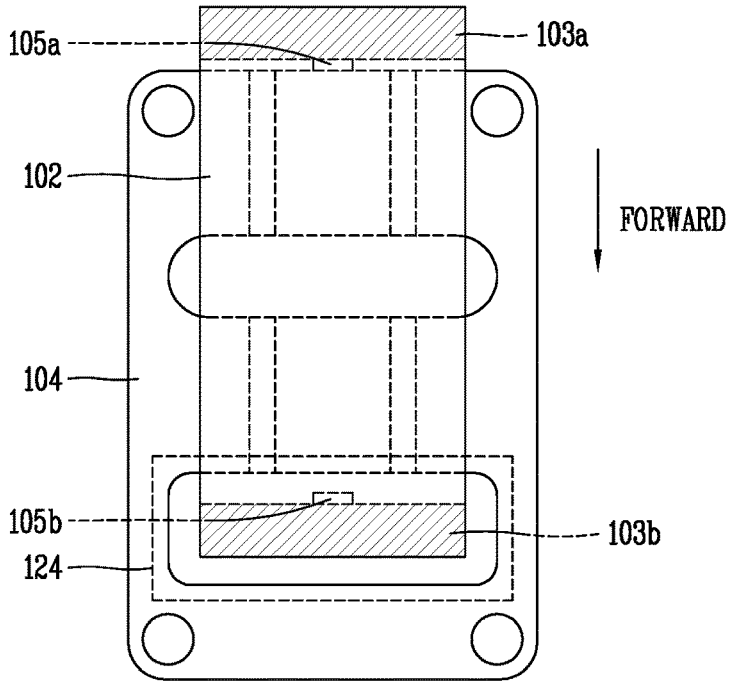
FIGS. 6A and 6B are conceptual views illustrating a method of operating a cleaner handle according to one embodiment of the present disclosure.
Figure 6B:
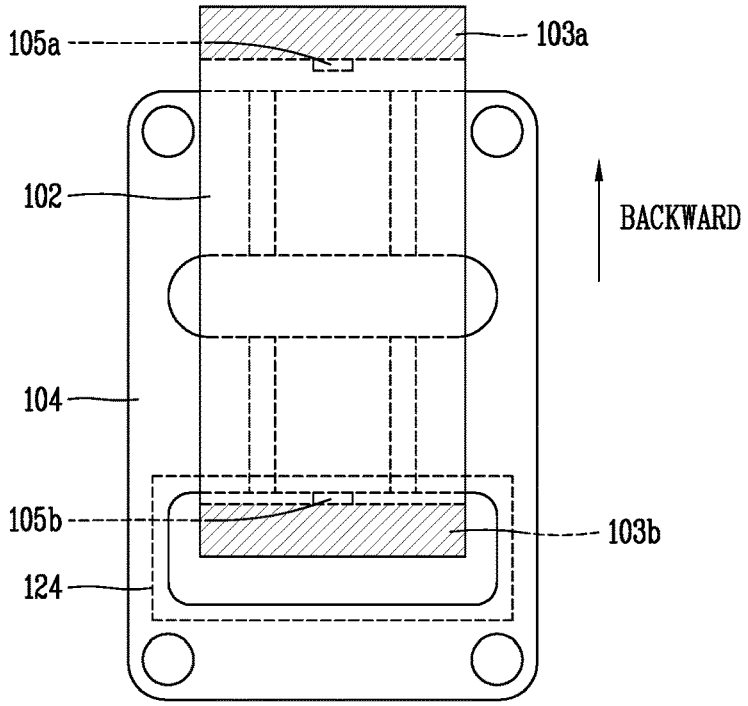

FIGS. 6A and 6B illustrate an example of an operation of the cleaner handle when the user applies external force to the cleaner handle illustrated in FIG. 3 in the forward or backward direction of the cleaner.

As illustrated in FIG. 6A, when the user pushes the grip member 101 in the forward direction of the cleaner, the first pressure sensor unit 105*a* provided on the first coupling member 103*a* may be brought into contact with the handle body 104.

Specifically, the guide module 102 may move in the forward direction of the cleaner with respect to the handle body 104 by the external force applied by the user to the grip member 101. Particularly, the guide module 102 may be slid in the forward direction of the cleaner until at least one of the first pressure sensor unit 105*a* and the first coupling member 103*a* are brought into contact with the handle body 104.

The first pressure sensor unit 105*a* may detect information related to strength of pressure applied from the outer surface of the handle body 104.

For example, the first pressure sensor unit 105*a* may detect whether or not pressure is applied simply from the handle body 104.

In another example, the first pressure sensor unit 105*a* may detect information related to the strength of the pressure applied from the handle body 104 at predetermined intervals.

On the other hand, in a state where the first pressure sensor unit 105*a* is in contact with a part of the outer surface of the handle body 104, even if the strength of the force applied by the user to the grip member 101 in the forward direction of the cleaner is increasing within a predetermined range, the guide module 102 may not move any more.

In addition, in the state where the first pressure sensor unit 105*a* is in contact with the part of the outer surface of the handle body 104, the second pressure sensor unit 105*b* and the second coupling member 103*b* may be spaced apart from the inner circumferential surface of the hole 124.

That is, the guide module 102 may be formed such that the second pressure sensor unit 105*b* and the second coupling member 103*a* are spaced apart from the inner circumferential surface of the hole 124 when the first pressure sensor unit 105*a* is in contact with the part of the outer surface of the handle body 104.

When the guide module 102 is formed too long, the second coupling member 103*b* may come into contact with the inner circumferential surface of the hole 124 even before the first pressure sensor unit 105*a* comes in contact with the handle body 104 yet.

Conversely, when the guide module 102 is formed excessively short, the guide module 102 may fail to be connected to the grip member 101 in the state where the part of the guide module 102 is inserted through the hole 124 of the handle body 104, as illustrated in FIG. 4.

Therefore, the length of the guide module 102 may be decided such that the guide module 102 can move relative to the handle body 104 along the direction of force applied by the user to the grip member 101 in the state where the part of the guide module 102 is inserted through the hole 124.

Also, referring to FIG. 6B, when the user pulls the grip member 101 in the backward direction of the cleaner, the second pressure sensor unit 105*b* provided on the second coupling member 103*b* may come in contact with the handle body 104.

Specifically, the guide module 102 may move relative to the handle body 104 in the backward direction of the cleaner, by external force applied by the user to the grip member 101. Particularly, the guide module 102 may be slid in the backward direction of the cleaner until at least one of the second pressure sensor unit 105*b* and the second coupling member 103*b* comes in contact with the inner circumferential surface of the hole 124 formed in the handle body 104.

The second pressure sensor unit 105*b* may detect information related to strength of pressure applied from the inner circumferential surface of the hole 124.

For example, the second pressure sensor unit 105*b* may detect whether or not pressure is applied simply from the inner circumferential surface of the hole 124.

In another example, the second pressure sensor unit 105*b* may detect information related to the strength of the pressure applied from the inner circumferential surface of the hole 124 at predetermined intervals.

On the other hand, even if the strength of the force applied by the user to the grip member 101 in the backward direction of the cleaner is increasing within a predetermined range in a state where the second pressure sensor unit 105*b* is in contact with a part of the inner circumferential surface of the hole 124, the guide module 102 may not move any more.

In addition, the first pressure sensor unit 105*a* and the first coupling member 103*a* may be spaced apart from the outer surface of the handle body 104 in the state where the second pressure sensor unit 105*b* comes in contact with the part of the inner circumferential surface of the hole 124.

Hereinafter, a method of operating the cleaner handle according to another embodiment of the present disclosure will be described, with reference to FIGS. 7A and 7B.

Figure 7A:
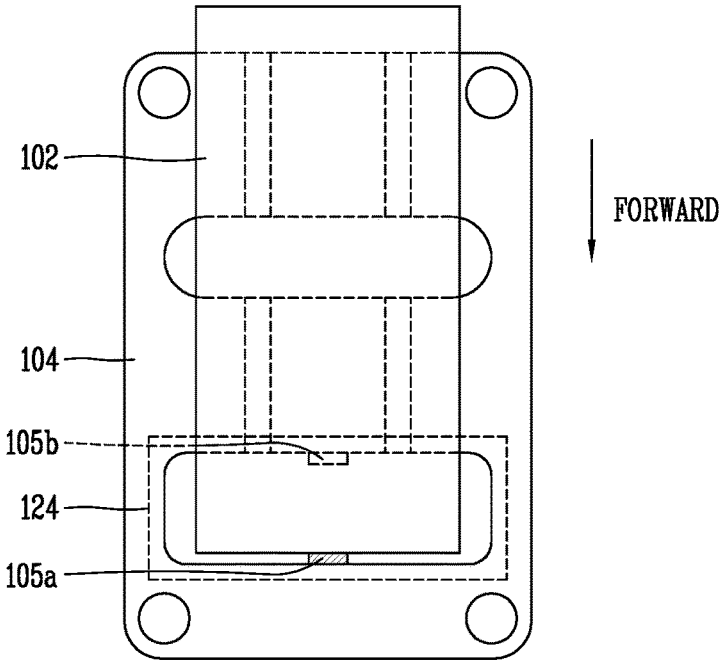
FIGS. 7A and 7B are conceptual views illustrating a method of operating a cleaner handle according to another embodiment of the present disclosure.
Figure 7B:
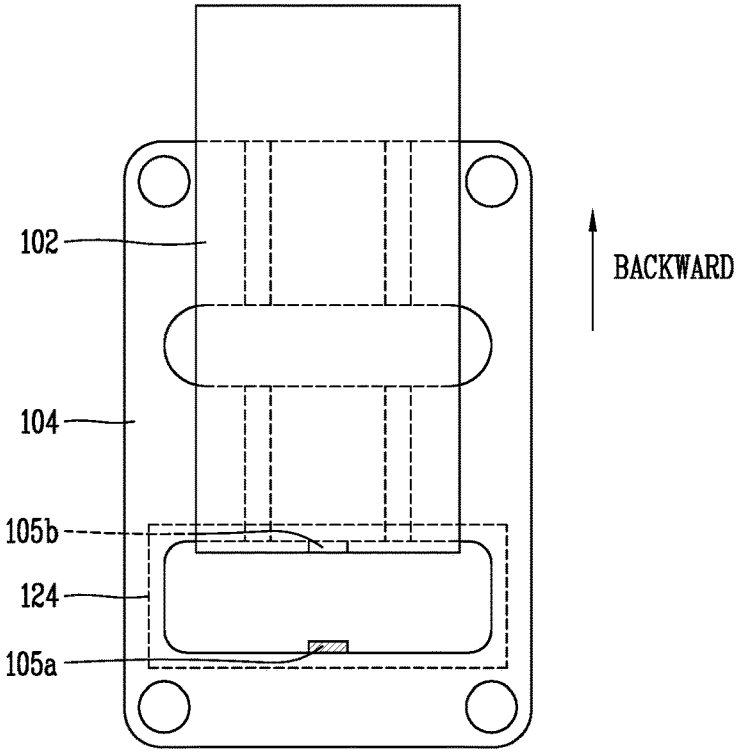

Comparing the embodiment of FIGS. 6A and 6B with the embodiment of FIGS. 7A and 7B, installation positions of the first pressure sensor unit 105*a* and the second pressure sensor unit 105*b* may be changed.

That is, according to the embodiment illustrated in FIGS. 7A and 7B, the first pressure sensor unit 105*a* and the second pressure sensor unit 105*b* may be installed at the inner circumferential surface of the hole 124.

Specifically, the first pressure sensor unit 105*a* and the second pressure sensor unit 105*b* may be provided at the inner circumferential surface of the hole 124 in a manner of facing each other.

In one example, the first pressure sensor unit 105*a* may be disposed on one surface of the inner circumferential surface of the hole 124, which faces the grip member 101, and the second pressure sensor unit 105*b* may be disposed on a surface of the inner circumferential surface of the hole, which faces the one surface.

In another example, the first pressure sensor unit 105*a* may be disposed on a part of the inner circumferential surface of the hole 124 existing in the forward direction of the cleaner based on the second coupling member 103*b* located inside the hole 124, and the second pressure sensor unit 105*b* may be disposed on another part of the inner circumferential surface of the hole 124 existing in the backward direction of the cleaner based on the second coupling member 103*b*.

FIGS. 7A and 7B have not illustrated a buffer member separately, but the buffer members may alternatively be provided between the first pressure sensor unit 105*a* and the second pressure sensor unit 105*b* and the inner circumferential surface of the hole 124, depending on the user's selection.

In addition, FIGS. 7A and 7B have not illustrated the first and second coupling members separately, but the feature that the first and second coupling members are provided on both ends of the guide module 102 has been described with reference to FIGS. 3, 6A and 6B.

Referring to FIG. 7A, when the user pushes the grip member 101 in the forward direction of the cleaner, the first pressure sensor unit 105*a* may be brought into contact with the guide module 102.

Specifically, the guide module 102 may move relative to the handle body 104 in the forward direction of the cleaner by external force applied by the user to the grip member 101. In particular, the guide module 102 may be slid in the forward direction of the cleaner until the first pressure sensor unit 105*a* comes in contact with the second coupling member 103*b*.

The first pressure sensor unit 105*a* may detect information related to strength of pressure applied from an outer surface of the guide module 102.

More specifically, the first pressure sensor unit 105*a* may detect information related to strength of pressure applied from an outer surface of the second coupling member 103*b* in the forward direction of the cleaner.

For example, the first pressure sensor unit 105*a* may detect whether or not pressure is applied simply from the guide module 102.

In another example, the first pressure sensor unit 105*a* may detect information related to the strength of the pressure applied from the guide module 102 at predetermined intervals.

On the other hand, in a state where the first pressure sensor unit 105*a* is in contact with the guide module 102, the second pressure sensor unit 105*b* may be spaced apart from the guide module 102.

Referring to FIG. 7B, when the user pulls the grip member 101 in the backward direction of the cleaner, the second pressure sensor unit 105*b* provided on the inner circumferential surface of the hole 124 may be brought into contact with the guide module 102.

Specifically, the guide module 102 may move relative to the handle body 104 in the backward direction of the cleaner, by external force applied by the user to the grip member 101. In particular, the guide module 102 may be slid in the backward direction of the cleaner until the second pressure sensor unit 105*b* comes in contact with the second coupling member 103*b*.

The second pressure sensor unit 105*b* may detect information related to strength of pressure applied from the guide module 102.

More specifically, the second pressure sensor unit 105*b* may detect information related to strength of pressure applied from the outer surface of the second coupling member 103*b* in the backward direction of the cleaner.

For example, the second pressure sensor unit 105*b* may detect whether or not pressure is applied simply from the guide module 102.

In another example, the second pressure sensor unit 105*b* may detect information related to the strength of the pressure applied from the guide module 102 at predetermined intervals.

On the other hand, in a state where the second pressure sensor unit 105*b* is in contact with the guide module 102, the first pressure sensor unit 105*a* may be spaced apart from the guide module 102.

As broadly described and embodied herein, an aspect of the present disclosure is to provide a vacuum cleaner, which performs a travel algorithm that reflects user's intention, to facilitate movement or travel of an upright type vacuum cleaner according to the user's intention, and a handle of the cleaner.

Another aspect of the present disclosure is to provide a vacuum cleaner, which actively reflects user's intention by providing separate physical force that assists movement of the cleaner in a user-intended direction, and a handle of the cleaner.

Another aspect of the present disclosure is to provide an upright type vacuum cleaner that follows a user, and a handle of the cleaner.

To achieve these and other advantages and in accordance with the purpose of the present disclosure, as embodied and broadly described herein, there is provided a handle for a cleaner, the handle including a grip member formed to be movable in a forward direction or a backward direction of the cleaner and gripped by a user, a guide module to guide the grip member to move in the forward direction or the backward direction of the cleaner, a handle body provided to move the guide module in the forward or backward direction of the cleaner, and a pressure sensor part to detect pressure generated between the guide module and the handle body, in response to the grip member moving in the forward direction or the backward direction of the cleaner.

According to one embodiment of the present disclosure, the handle body may be provided with grooves formed on a surface, on which the guide module is disposed, of outer surfaces of the handle body, to guide the movement of the guide module.

According to one embodiment of the present disclosure, the guide module may include a first plate and a second plate, and the handle body may be located between the first plate and the second plate.

According to one embodiment of the present disclosure, ribs may be provided respectively on surfaces of the first and second plates, which face the handle body, and the ribs may be inserted into the grooves provided in the outer surface of the handle body.

According to one embodiment of the present disclosure, each of the grooves may be formed to have a width of a predetermined length so as to be parallel with the forward or backward direction.

According to one embodiment of the present disclosure, a width of each of the ribs provided on the first and second plates may be smaller than the width of the groove.

According to one embodiment of the present disclosure, the guide module may include a first coupling member and a second coupling member to couple the first and second plates to each other. The first coupling member may be located between the handle body and the grip member, and the second coupling member may be located in a hole formed in the handle body.

According to one embodiment of the present disclosure, the pressure sensor part may include a first pressure sensor unit and a second pressure sensor unit. The first pressure sensor unit may detect information related to strength of pressure applied by the guide module when a user moves the grip member in the forward direction to be brought into contact with the guide module, and the second pressure sensor unit may detect information related to strength of pressure applied by the guide module when the user moves the grip member in the backward direction to be brought into contact with the guide module.

According to one embodiment of the present disclosure, the first pressure sensor unit may be provided on one surface of the first coupling member.

According to one embodiment of the present disclosure, a buffer member may be provided between the first pressure sensor unit and the first coupling member.

According to one embodiment of the present disclosure, the second pressure sensor unit may be provided on one surface of the second coupling member.

According to one embodiment of the present disclosure, the grip member may be coupled to another surface of the first coupling member, which is opposed to the one surface having the first pressure sensor unit.

According to one embodiment of the present disclosure, a distance between a point where the first pressure sensor unit is installed and a point where the second pressure sensor unit is installed may be shorter than a length of the handle body in the forward or backward direction.

According to another aspect of the present disclosure, there is provided a cleaner, including a cleaner body, a handle provided on the cleaner body and gripped by a user, a driving unit provided at a lower portion of the cleaner body to move the cleaner body, and a controller to control the driving unit based on detected pressure. The handle may include a grip member formed to be movable in a forward direction or a backward direction of the cleaner body, a guide module to guide the grip member to move in the forward direction or the backward direction of the cleaner, a handle body coupled with the guide module, and a pressure sensor part to detect pressure generated between the guide module and the handle body, in response to the grip member moving in the forward direction or the backward direction of the cleaner. The controller may determine whether the cleaner body moves forward or backward using information detected by a pressure sensor part, and control the driving unit based on the determination result.

According to one embodiment of the present disclosure, the pressure sensor part may include a first pressure sensor unit and a second pressure sensor unit. The first pressure sensor unit may detect information related to strength of pressure applied by the guide module when the user moves the grip member in the forward direction to be brought into contact with the guide module, and the second pressure sensor unit may detect information related to strength of pressure applied by the guide module when the user moves the grip member in the backward direction to be brought into contact with the guide module.

According to one embodiment of the present disclosure, the controller may determine that the cleaner body is moving forward when an output of the first pressure sensor unit is greater than or equal to a predetermined value, and control the driving unit to provide auxiliary driving force in the forward direction of the cleaner body.

According to one embodiment of the present disclosure, the controller may determine that the cleaner body is moving backward when an output of the second pressure sensor unit is greater than or equal to a predetermined value, and control the driving unit to provide auxiliary driving force in the backward direction of the cleaner body.

According to a vacuum cleaner and a control method thereof according to the present disclosure, user's intention to move the cleaner can be recognized and thus auxiliary driving force can be provided in a direction intended by the user, thereby improving user's convenience.

Further, the user of the vacuum cleaner according to the present disclosure can easily move a cleaner body in a desired direction even with small force. In addition, according to these advantages, a load applied on the user's finger or wrist can be minimized, thereby improving the user's convenience.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A handle for a cleaner, comprising:

a grip formed to be gripped by a user;

a guide assembly coupled to the grip;

a handle body coupled to the guide assembly, wherein the grip and the guide assembly are movably coupled to the handle body in a forward direction or a backward direction relative to the guide assembly corresponding to a forward motion or a backward motion of the cleaner, respectively; and a pressure sensor formed between the guide assembly and the handle body, and configured to detect pressure generated by a movement of the grip in the forward direction or the backward direction, wherein the guide assembly is configured to be movable in the forward direction or the backward direction relative to the handle body in a state of being coupled to the handle body, and includes a first plate and a second plate, wherein the handle body is located between the first plate and the second plate, wherein the handle body is provided with at least one groove formed on a surface on which the guide assembly is disposed to guide movement of the guide assembly, wherein at least one rib is provided on a surface of at least one of the first plate or the second plate, the at least one rib provided to protrude from the first or second plate toward the handle body, and wherein the at least one rib is inserted into the at least one groove provided on an outer surface of the handle body.

2. The handle of claim 1, wherein the at least one groove is formed to have a constant width along a direction parallel with the forward or backward direction.

3. The handle of claim 2, wherein a width of the at least one rib provided on the first or second plates is less than the width of the groove by a prescribed amount to provide a prescribed amount of resistance in the movement of the guide assembly relative to the handle body.

4. The handle of claim 1, wherein the guide assembly includes a first coupling plate and a second coupling plate to couple the first and second plates to each other, wherein the first coupling plate is provided between the handle body and the grip and the second coupling plate is provided in the handle body in a hole formed in the handle body.

5. The handle of claim 4, wherein the pressure sensor includes a first pressure sensor and a second pressure sensor, wherein the first pressure sensor detects an amount of pressure during contact between the guide assembly and the handle body when the user moves the grip in the forward direction, and wherein the second pressure sensor detects an amount of pressure during contact between the guide assembly and the handle body when the user moves the grip in the backward direction.

6. The handle of claim 5, wherein the first pressure sensor is provided on a first surface of the first coupling plate that faces the handle body.

7. The handle of claim 6, wherein a buffer member is provided between the first pressure sensor and the first coupling plate.

8. The handle of claim 6, wherein the grip is coupled to a second surface of the first coupling plate, the second surface being an outer surface opposite to the first surface having the first pressure sensor.

9. The handle of claim 5, wherein the second pressure sensor is provided on a surface of the second coupling plate.

10. The handle of claim 5, wherein a distance between a first location where the first pressure sensor is installed and a second location where the second pressure sensor is installed is less than a length of the handle body in the forward or backward direction.

11. A cleaner, comprising:

a cleaner body;

a handle formed on the cleaner body and to be gripped by a user;

a drive assembly including a motor and a wheel provided at a lower portion of the cleaner body to move the cleaner body; and a controller configured to control the drive assembly based on a pressure detected at the handle, wherein the handle includes:

a grip provided to move in a forward direction or a backward direction relative to a movement of the cleaner body;

a guide assembly coupled to the grip and to guide the grip to move in the forward direction or the backward direction relative to the movement of the cleaner body;

a handle body coupled to the guide assembly, and a pressure sensor provided between the guide assembly and the handle body to detect pressure generated by a movement of the grip in the forward direction or the backward direction, wherein the guide assembly is configured to be movable relative to the forward or backward direction of the movement of the cleaner body in a state of being coupled with the handle body, and wherein the controller determines whether to move the cleaner body forward or backward using information detected by the pressure sensor, and controls the drive assembly based on the determination result, wherein the pressure sensor includes a first pressure sensor and a second pressure sensor, wherein the first pressure sensor detects an amount of pressure applied between the guide assembly and the handle body when the user moves the grip in the forward direction, and wherein the second pressure sensor detects an amount of pressure applied between the guide assembly and the handle body when the user moves the grip in the backward direction.

12. The cleaner of claim 11, wherein the controller determines that the cleaner body is moving forward when an output of the first pressure sensor is greater than or equal to a prescribed value, and controls the drive assembly to provide auxiliary driving force in the forward direction.

13. The cleaner of claim 11, wherein the controller determines that the cleaner body is moving backward when an output of the second pressure sensor is greater than or equal to a prescribed value, and controls the drive assembly to provide auxiliary driving force in the backward direction.

14. The cleaner of claim 11, wherein the controller determines that the cleaner body is moving forward when the output of the first pressure sensor is greater than an output of the second pressure sensor, and controls the drive assembly to supply auxiliary driving force in the forward direction.

15. The cleaner of claim 11, wherein the controller determines that the cleaner body is moving backward when an output of the second pressure sensor is greater than the output of the first pressure sensor, and controls the drive assembly to supply auxiliary driving force in the backward direction.

16. The cleaner of claim 11, wherein the controller determines that an external force is being applied to the grip to move the cleaner forward when a rate of increase of the output of the first pressure sensor exceeds a reference value, and controls the drive assembly to supply auxiliary driving force in the forward direction.

17. A handle for a cleaner, the handle comprising:

a grip;

a guide module including a first plate, a second plate, a third plate, and a fourth plate, wherein the first and second plates are connected together by the third and fourth plates;

a handle body positioned between the first plate and the second plate, the handle body including at least one groove to guide movement of the guide module, and a hole to receive the fourth plate of the guide module, wherein the grip and the guide module are movably coupled to the handle body in a forward direction or a backward direction relative to the guide module, and wherein the third plate is provided between the handle body and the grip; and a sensor between the guide module and the handle body and configured to detect pressure generated by a movement of the grip in the forward direction or the backward direction.

18. The handle of claim 17, wherein the sensor includes a first sensor and a second sensor, wherein the first sensor detects an amount of pressure associated with a contact between the guide module and the handle body when the grip moves in the forward direction, and wherein the second sensor detects an amount of pressure during a contact between the guide module and the handle body when the grip moves in the backward direction.

19. The handle of claim 18, wherein the first pressure sensor is provided on a first surface of the third plate that faces the handle body, and the second pressure sensor is provided at the fourth plate.

20. The handle of claim 19, wherein the grip is coupled to a second surface of the third plate, the second surface being opposite to the first surface of the third plate where the first sensor is positioned.

* * * * *